US009534740B2

(12) United States Patent
Tokarz et al.

(10) Patent No.: US 9,534,740 B2
(45) Date of Patent: Jan. 3, 2017

(54) LED INDUCTION COMBINATION LIGHTING SYSTEM

(71) Applicant: American Green Technology, Inc., South Bend, IN (US)

(72) Inventors: Steve Tokarz, Superior Township, MI (US); John Michael Killmeyer, Allen, TX (US)

(73) Assignee: American Green Technology, Inc., South Bend, IN (US)

( * ) Notice: Subject to any disclaimer, the term of this patent is extended or adjusted under 35 U.S.C. 154(b) by 6 days.

(21) Appl. No.: 14/813,307

(22) Filed: Jul. 30, 2015

(65) Prior Publication Data

US 2016/0033087 A1 Feb. 4, 2016

Related U.S. Application Data

(60) Provisional application No. 62/030,818, filed on Jul. 30, 2014.

(51) Int. Cl.

| | |
|---|---|
| ***F21K 99/00*** | (2016.01) |
| ***F21V 29/74*** | (2015.01) |
| ***F21V 7/22*** | (2006.01) |
| ***F21V 23/02*** | (2006.01) |
| ***F21V 7/04*** | (2006.01) |
| ***F21V 29/77*** | (2015.01) |
| *F21V 23/00* | (2015.01) |
| *F21Y 101/00* | (2016.01) |

(52) U.S. Cl.

CPC ..... *F21K 9/13* (2013.01); *F21V 7/048* (2013.01); *F21V 7/22* (2013.01); *F21V 23/02* (2013.01); *F21V 29/74* (2015.01); *F21V 29/773* (2015.01); *F21V 23/003* (2013.01); *F21Y 2101/00* (2013.01); *F21Y 2113/20* (2016.08)

(58) Field of Classification Search

CPC ..... F21K 9/13; F21V 29/74; F21V 29/773; F21V 7/048; F21V 7/22; F21V 23/02; F21V 23/003; F21Y 2113/20; F21Y 2101/00

USPC ..... 362/235, 228, 216, 192

See application file for complete search history.

(56) References Cited

U.S. PATENT DOCUMENTS

| | | | | |
|---|---|---|---|---|
| 5,685,637 | A | 11/1997 | Chapman et al. | |
| 7,784,963 | B2 | 8/2010 | Galli et al. | |
| 8,398,280 | B2 | 3/2013 | Miyagawa | |
| 2006/0082992 | A1 | 4/2006 | Yuen | |
| 2007/0115654 | A1* | 5/2007 | Ruben | F21S 8/06 362/221 |
| 2007/0153504 | A1 | 7/2007 | Thornhill | |
| 2008/0285263 | A1* | 11/2008 | Garrett | F21V 19/0075 362/216 |
| 2011/0211342 | A1* | 9/2011 | Sandoval | F21S 8/06 362/216 |
| 2013/0010464 | A1* | 1/2013 | Shuja | F21V 29/402 362/235 |
| 2013/0016507 | A1* | 1/2013 | Yeh | F21V 23/0471 362/235 |
| 2013/0250563 | A1 | 9/2013 | Kuo | |
| 2013/0293102 | A1 | 11/2013 | Yeh | |
| 2014/0078766 | A1 | 3/2014 | Giametta | |

* cited by examiner

*Primary Examiner* — Laura Tso

(57) ABSTRACT

A lighting system includes a reflector housing with a LED light source having multiple LEDs and an induction light source located within the reflector housing.

20 Claims, 6 Drawing Sheets

LED INDUCTION COMBINATION LIGHTING SYSTEM

CROSS-REFERENCE TO RELATED APPLICATIONS

This application claims priority to U.S. Provisional Application No. 62/030,818, which was filed on Jul. 30, 2014.

TECHNICAL FIELD

This application relates to lighting fixtures and more particularly to lighting fixture with multiple lighting sources.

BACKGROUND

As individuals and businesses are looking to reduce their utility costs, reducing energy consumption from the cost of lighting is one of the first places to look to reduce utility costs. As lighting becomes more efficient as evidenced, for instance, by the introduction of LED technology into homes and businesses, consumers are able to reduce their utility costs. However, with the introduction of new and more efficient lighting fixtures, there is a need for the light fixtures to meet the lighting demands that the users require while still offering a reduction in energy costs.

SUMMARY OF THE DISCLOSURE

A lighting system includes a reflector housing with a LED light source having multiple LEDs and an induction light source located within the reflector housing.

A method for utilizing a lighting system includes directing a LED light source having multiple LEDs at a reduced angle at a task area from a reflector housing and directing an induction light source from the reflector housing at an area surrounding the task area.

DETAILED DESCRIPTION

Figure 1:
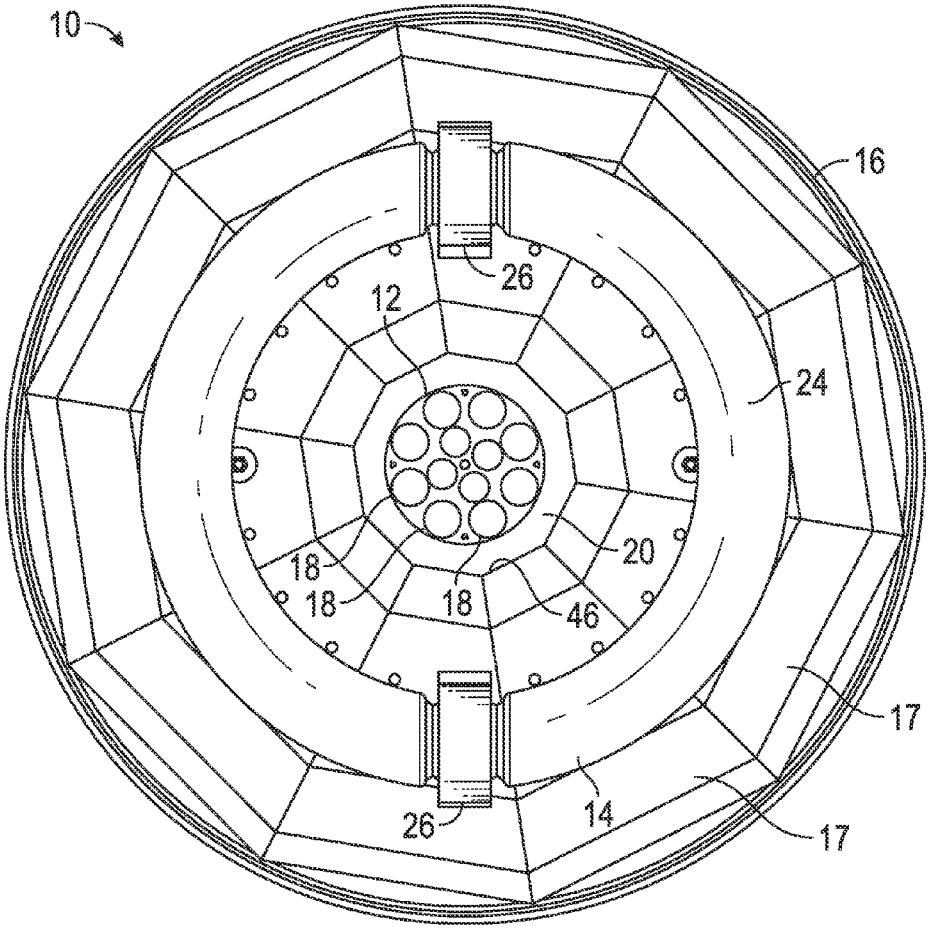
FIG. 1 is a bottom view of a light fixture according to a first non-limiting embodiment.

A lighting system 10 is shown in FIG. 1. The lighting system 10 includes a LED light source 12 and an induction light source 14. The LED light source 12 and induction light source 14 are both disposed within a reflector housing 16 which directs light forward of the reflector housing 16. The reflector housing 16 includes a plurality of reflectors 17 for directing light.

Figure 2:
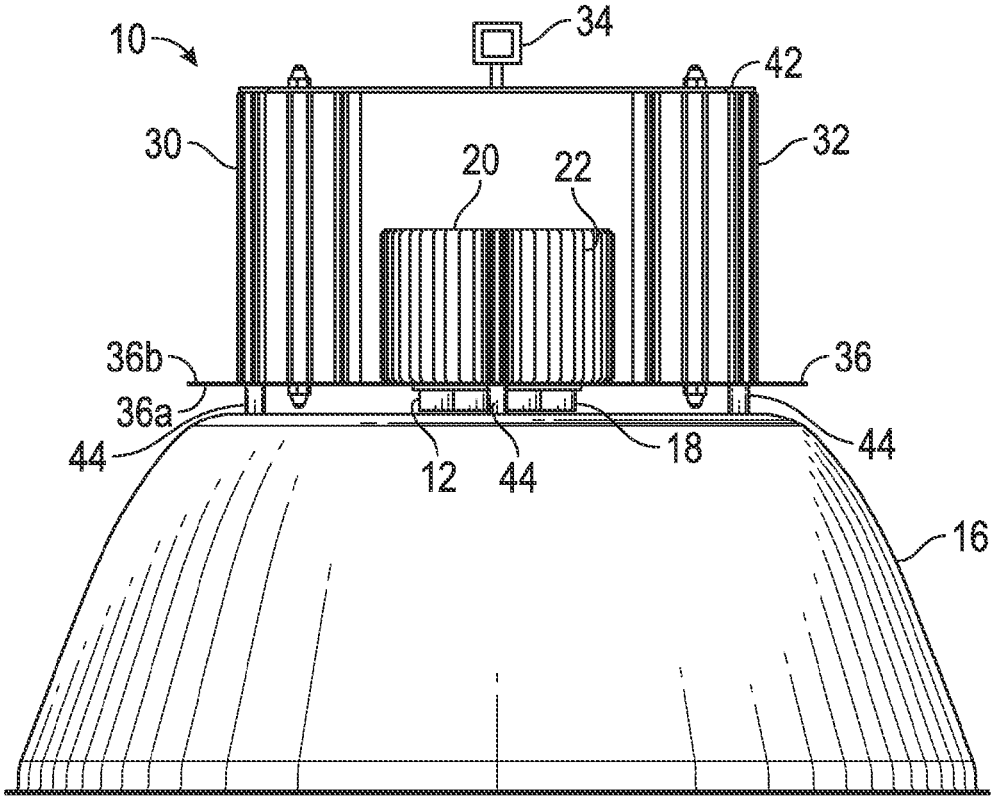
FIG. 2 is a side view of the light fixture according to the first non-limiting embodiment.
Figure 3:
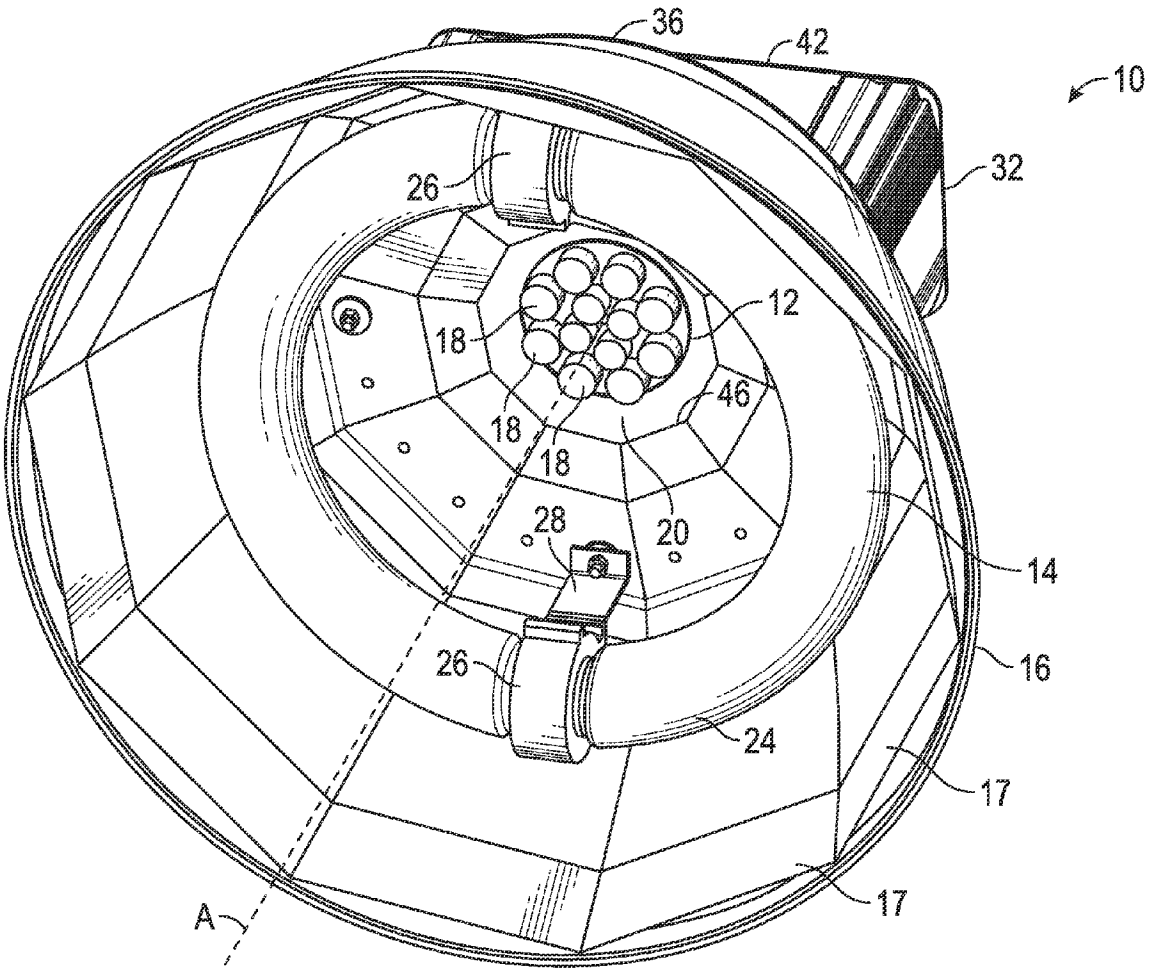
FIG. 3 is a bottom perspective view of the light fixture according to the first non-limiting embodiment.

The LED light source 12 includes a plurality of LEDs 18 mounted on a heat sink or base 20. In another non-limiting embodiment, the LED light source 12 includes at least one LED 18 mounted on the base 20. The base 20 has heat dissipating fins 22 (FIG. 2). The induction light source 14 includes a tube 24 (in this case an annular tube 24) supported by coils 26 secured to the reflector housing 16 by brackets 28 (FIG. 3). However, the tube 24 could also be rectangular or elliptical.

FIG. 2 is a side view of the lighting system 10. A driver 30 for powering the LED light source 12 (FIG. 1) and a generator 32 for powering the induction light source 14 (FIG. 1) are mounted outside the reflector housing 16. Wired connections from the driver 30 to the LED light source 12 and from the generator 32 to the induction light source 14 are not shown.

The driver 30 and the generator 32 extend between a first mounting plate 36 adjacent the reflector housing 16 to a second mounting plate 42 on an opposite end of the driver 30 and the generator 32 from the first mounting plate 36. Mounting hardware such as a loop or hook 34 extends from the rear end of the lighting system 10.

The plurality of LEDs 18 on the LED light source 12 extend through an opening in the first mounting plate 36 such that the plurality of LEDs 18 are located adjacent a first side 36*a* of the first mounting plate 36 adjacent the reflector housing 16. The base 20 is located adjacent a second side 36*b* of the first mounting plate 36 opposite the first side 36*a*. The base 20 is spaced from the driver 30 and the generator 32 to allow for sufficient cooling air to pass over the heat dissipating fins 22. The reflector housing 16 is secured to the first mounting plate 36 with a plurality of legs 44 extending between the first mounting plate 36 and the reflector housing 16. The plurality of legs 44 maintain a spacing between the first mounting plate 36 and the reflector housing 16.

Figure 4:
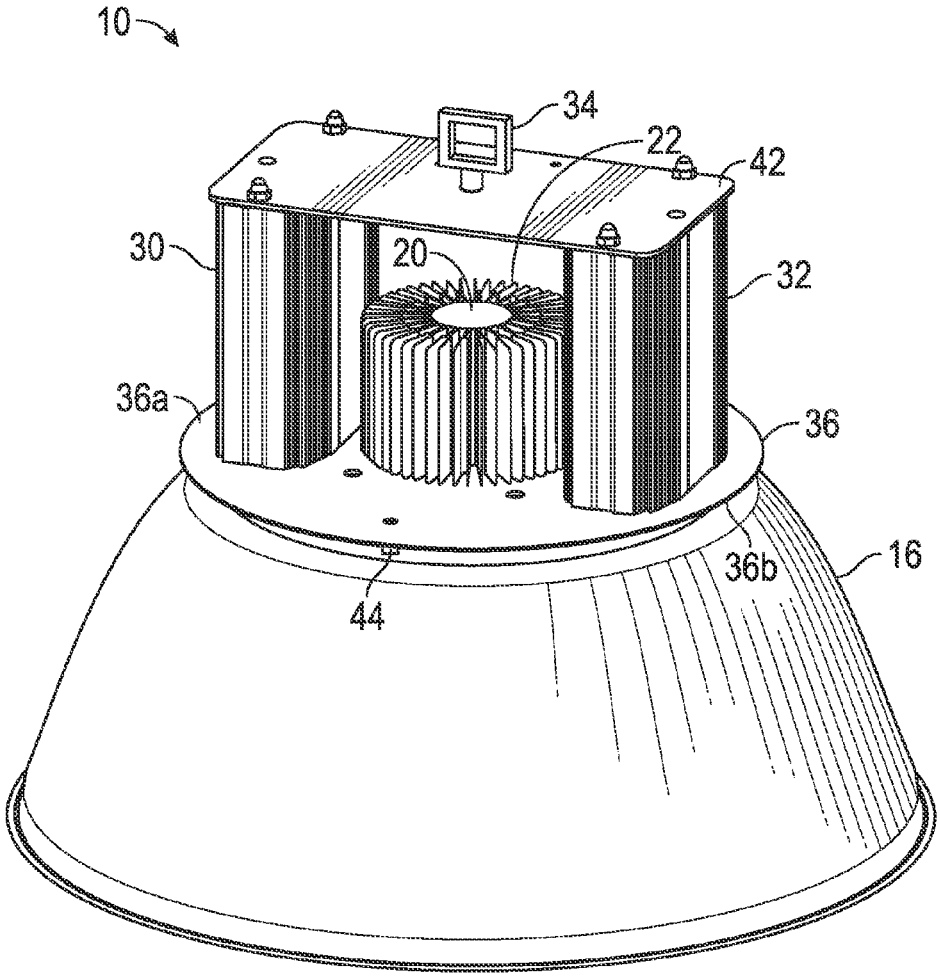
FIG. 4 is a top perspective view of the light fixture according to the first non-limiting embodiment.

FIG. 3 shows a bottom perspective view of the lighting system 10 and FIG. 4 shows a top perspective view of the lighting system 10. As shown, the induction light source 14 in this particular example includes the annular tube 24 and the LED light source 12 is mounted at the center of the annular tube 24 adjacent a LED opening 46 in the reflector housing 16. In the illustrated example, the LED light source 12 and the induction light source 14 are centered along the longitudinal axis A of the reflector housing 16 and axially spaced from each other. Other arrangements may be used, but the arrangement shown in FIG. 3 offers some benefits in high height lighting applications.

Figure 5:
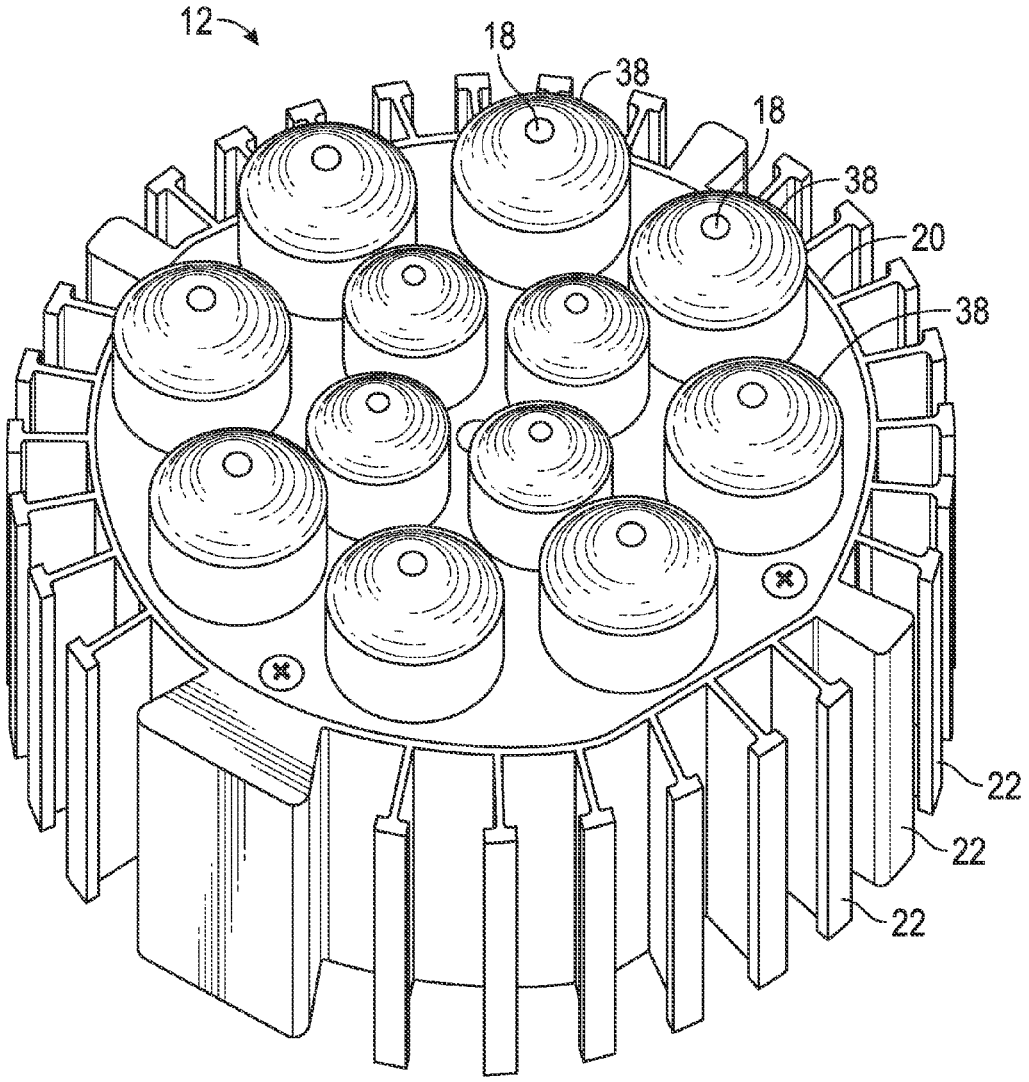
FIG. 5 is a perspective view of a LED light source according to a first non-limiting embodiment.

FIG. 5 is an enlarged perspective view of the LED light source 12 according to a first non-limiting embodiment. As shown, the LEDs 18 are mounted on the base 20, which includes the heat dissipating fins 22 extending radially outward therefrom. Each of the LEDs 18 includes a light directing element, such as a lens 38, mounted in front of the LED 18 to focus light from the LED 18 more narrowly. In this particular embodiment, the lenses 38 are 14 degree lenses. The distribution pattern from the lens 38 is complementary to the distribution pattern from the induction light source 14, such that as the light sources 12, 14 are merged, the spectral enhancement is additive with virtually no interference. Other lenses may be used, depending upon a particular application, such as lenses greater than 14 degrees or lens between 10 and 120 degrees.

Figure 6:
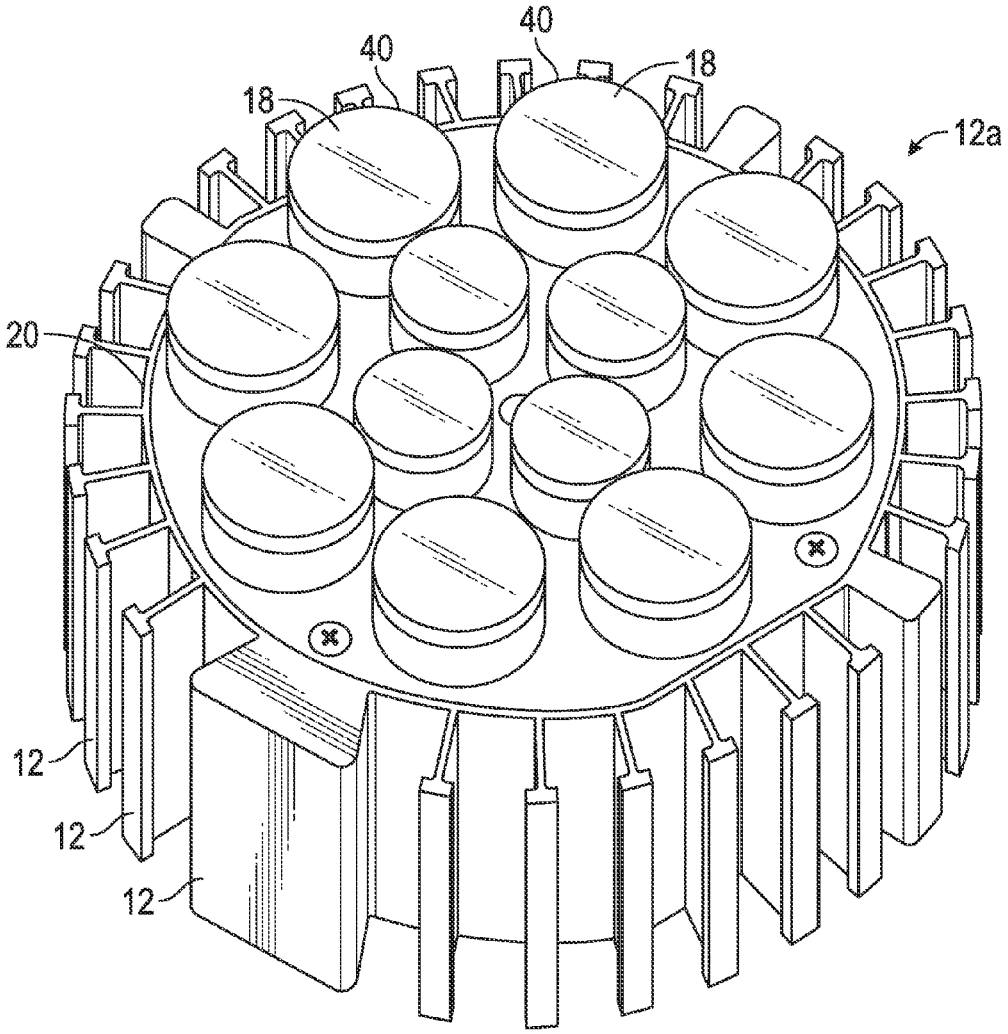
FIG. 6 is a perspective view of a LED light source according to a second non-limiting embodiment.

FIG. 6 shows an alternate LED light source 12*a* according to a second non-limiting embodiment having the same base 20, heat dissipating fins 22, and LEDs 18. The LED light source 12*a* uses a light directing element, such as reflectors 40, instead of the lenses 38 (FIG. 5). In this embodiment, the reflectors 40 cast light at 40 degree, providing a wider source of light from the LED light source 12*a*. Other reflectors may be used, depending on the particular lighting application, such as reflectors greater than 14 degrees or reflectors between 10 and 120 degrees.

In high height applications, such as a warehouse or factory, a very narrow light beam is useful to be directed at the task area; however, there is also a need for light to be distributed around that task area. In the lighting system 10 disclosed above, the LED light source 12 (or LED light source 12*a*) provides a high level of light directional at the task area while the induction light source 14 disperses sufficient light to the area surrounding the task area. This combination lighting system 10 thus provides an efficient combination light source that provides high light to the task area and sufficient light to the surrounding area even in high height applications. Alternatively, the LED light source 12 could project a wider band of light for use in low height applications or the lighting system 10 could be inverted to project light upward.

In this particular embodiment, the LED light source 12 (and 12*a*) is color-matched to the induction light source 14. This improves the efficiency of the lighting system 10 and provides a seamless transition between the light sources 12, 14. In one particular non-limiting embodiment, the light sources 12, 14 were color matched at 5000K, although other color temperatures could also be used. In yet another non-limiting embodiment, the light sources 12, 14 are color temperature matched between 4800K and 5200K and in a further non-limiting embodiment, the light sources 12, 14 are color temperature matched within 10 percent of each other. Additionally color rendering and special spectral distribution affects can be attained so that the LED light source 12 and the induction light source 14 it is paired can create a new spectral distribution that is unique and additive.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A lighting system comprising:

a reflector housing;

a LED light source including at least one LED, the at least one LED is located adjacent to the reflector housing; and an induction light source located at least partially within the reflector housing.

2. The lighting system of claim 1, wherein the LED light source includes a plurality of LEDs.

3. The lighting system of claim 1, wherein the at least one LED is located adjacent a heat sink.

4. The lighting system of claim 3, wherein the heat sink is located on a first side of the reflector housing and the induction light is located on a second side of the reflector housing.

5. The lighting system of claim 2, comprising a light directing element on the at least one LED.

6. The lighting system of claim 5, wherein the light directing element directs light at an angle of 10 degrees or greater.

7. The lighting system of claim 1, wherein the induction light source forms a closed lamp profile.

8. The lighting system of claim 7, wherein the induction light source includes an annular tubing shape.

9. The lighting system of claim 1, wherein the LED light source is aligned with a center of the induction light source.

10. The lighting system of claim 9, wherein the LED light source and the center of the induction light source are aligned with a longitudinal axis of the reflector housing.

11. The lighting system of claim 9, wherein the LED light source is axially spaced from the induction light source relative to a longitudinal axis of the reflector housing.

12. The lighting system of claim 1, wherein the color temperature of the LED light source is matched with the color lighting temperature of the induction light source.

13. The lighting system of claim 1, comprising a driver for powering the LED light source and a generator for powering the induction light source.

14. The lighting system of claim 13, wherein the driver and the generator extend between a first mounting plate and a second mounting plate and the first mounting plate is secured to the reflector housing and a heat sink for the first LED light source is located adjacent the first mounting plate and spaced from the reflector housing.

15. The lighting system of claim 1, comprising a first mounting plate secured to the reflector housing with a plurality of legs, the plurality of legs creating a spacing between the first mounting plate and the reflector housing.

16. A method for utilizing a lighting system comprising:

directing a LED light source having a at least one LED through a light directing element at a task area from a reflector housing; and directing an induction light source from the reflector housing at an area surrounding the task area.

17. The method of claim 16, comprising color temperature and color rendering matching the LED light source with the induction light source.

18. The method of claim 16, wherein the light directing element projects light at an angle of 10 degrees or greater.

19. The method of claim 16, wherein a center of the LED light source and a center of the induction light source are aligned with a longitudinal axis of the reflector housing.

20. The method of claim 16, wherein the LED light source is axially spaced from the induction light source relative to a longitudinal axis of the reflector housing.

* * * * *